US011248515B2

(12) United States Patent
Patil

(10) Patent No.: US 11,248,515 B2
(45) Date of Patent: Feb. 15, 2022

(54) PISTON COOLING JET SYSTEM

(71) Applicant: Transportation IP Holdings, LLC, Norwalk, CT (US)

(72) Inventor: Abhijit Eknath Patil, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 250 days.

(21) Appl. No.: 16/530,862

(22) Filed: Aug. 2, 2019

(65) Prior Publication Data

US 2021/0033019 A1 Feb. 4, 2021

(51) Int. Cl.

| | |
|---|---|
| ***F01P 3/08*** | (2006.01) |
| ***F01P 3/10*** | (2006.01) |
| ***F02F 1/10*** | (2006.01) |
| ***F01M 1/08*** | (2006.01) |
| ***F01M 11/02*** | (2006.01) |
| ***B61C 5/02*** | (2006.01) |
| *F01P 3/00* | (2006.01) |

(52) U.S. Cl.

CPC *F01P 3/08* (2013.01); *B61C 5/02* (2013.01); *F01M 1/08* (2013.01); *F01M 11/02* (2013.01); *F01P 3/10* (2013.01); *F02F 1/10* (2013.01); *F01P 2003/006* (2013.01)

(58) Field of Classification Search

CPC ..... F01P 3/08; F01P 3/06; F01P 3/10; F01P 7/14; F01P 2003/006; F02F 3/22; F02F 3/20; F02F 1/10; F01M 1/08; F01M 11/02; F01M 2001/083

See application file for complete search history.

(56) References Cited

U.S. PATENT DOCUMENTS

| | | | | |
|---|---|---|---|---|
| 4,206,726 | A * | 6/1980 | Johnson, Jr. | F01P 3/08 123/41.35 |
| 4,408,575 | A | 10/1983 | Clairmont, Jr. et al. | |
| 4,715,335 | A * | 12/1987 | Elsbett | F01M 1/08 123/198 E |
| 4,862,838 | A * | 9/1989 | Hodgkins | F01P 3/08 123/41.35 |
| 6,742,481 | B2 * | 6/2004 | Baldwin | F01M 1/08 123/41.35 |
| 6,895,905 | B2 * | 5/2005 | Bontaz | F01P 3/08 123/41.35 |
| 7,201,118 | B2 * | 4/2007 | Lenz | F01M 1/08 123/196 R |
| 7,350,484 | B2 * | 4/2008 | Bontaz | F01M 1/08 123/196 R |

(Continued)

OTHER PUBLICATIONS

Patil, A., "An Ornamental Design for a Piston Cooling Apparatus," U.S. Appl. No. 29/700,594, filed Aug. 2, 2019, 6 pages.

(Continued)

*Primary Examiner* — Grant Moubry

(74) *Attorney, Agent, or Firm* — McCoy Russell LLP

(57) ABSTRACT

Systems are provided for a piston cooling jet system for cooling a piston of a locomotive engine. In one example, a piston cooling jet system includes a feed body hydraulically coupled to an oil reservoir and a pair of piston cooling tubes extending radially outwards, in opposite directions, from the feed body. The tubes may have showerhead outlet features at one end for uniformly spraying oil onto inlets of a piston oil gallery housed in the piston.

19 Claims, 8 Drawing Sheets

(56) References Cited

U.S. PATENT DOCUMENTS

| | | | | |
|---|---|---|---|---|
| 7,360,510 | B2 * | 4/2008 | Bontaz | F01P 3/08 123/41.35 |
| 8,267,053 | B2 * | 9/2012 | Abe | F01M 1/08 123/41.35 |
| 8,707,927 | B2 * | 4/2014 | Hazelton | F01M 1/08 123/196 R |
| 8,875,668 | B2 * | 11/2014 | Bennington | F01P 3/06 123/41.35 |
| 9,476,344 | B2 * | 10/2016 | Clement | F01P 3/08 |
| 9,850,791 | B2 * | 12/2017 | Gokan | F01M 1/08 |
| 9,926,829 | B2 * | 3/2018 | Raman | F02F 3/22 |
| 10,233,816 | B2 * | 3/2019 | Honda | F01M 1/08 |
| 10,273,841 | B2 * | 4/2019 | Kuroda | F01M 9/108 |
| 2008/0210314 | A1 * | 9/2008 | Neto | F16K 15/044 137/539 |
| 2010/0001103 | A1 * | 1/2010 | Neto | F01P 3/08 239/583 |
| 2013/0179049 | A1 * | 7/2013 | Grieser | F01P 3/06 701/102 |
| 2016/0363034 | A1 * | 12/2016 | Kim | F01M 11/02 |
| 2018/0363537 | A1 * | 12/2018 | Mark | B05B 1/06 |

OTHER PUBLICATIONS

Patil, A., "An Ornamental Design for a Piston Cooling Apparatus," U.S. Appl. No. 29/700,598, filed Aug. 2, 2019, 6 pages.

* cited by examiner

PISTON COOLING JET SYSTEM

FIELD

A piston cooling jet system is described for a locomotive engine.

BACKGROUND

Heat is produced by an internal combustion engine during operation, particularly at higher rotational speeds and loads. The generated heat places a demand on the engine's cooling system to reduce over-heating of engine components. For example, piston cooling is enabled, at least in part, by piston cooling jets (PCJ) which spray jets of oil to an oil gallery inside engine pistons. The sprayed oil absorbs the heat of combustion before draining away, carrying heat away from the piston. The oil delivered to the PCJ is accelerated via an oil pump that may have variable oil pressure.

Sufficient piston cooling may require significant oil pressure to be generated by the oil pump. This may be energy intensive. Further, there may be hot spots on the piston where more heat is generated. If oil does not reach those hot spots, even with the operation of the cooling jets, the pistons may not be cooled enough. Inadequate piston cooling may lead to piston, piston pin and piston rings scuffing, piston cracking, and oil coking which may result in degradation of the engine components.

BRIEF DESCRIPTION OF THE INVENTION

A piston cooling jet system is provided for improving the efficiency of piston cooling and extending the life of a cylinder piston. In one embodiment, the piston cooling system, comprises: a feed body hydraulically coupled to an oil reservoir, the feed body having a longitudinal axis, a first piston cooling tube extending laterally to protrude radially out from one side of the feed body relative to the longitudinal axis, the first tube having a first showerhead outlet element, and a second piston cooling tube extending laterally to protrude radially out from another, side of the feed body relative to the longitudinal axis, the second tube having a second showerhead outlet element.

In one example embodiment, a piston cooling jet system may comprise a feed body coupled to a cylinder bore to supply oil to a piston for cooling and lubricating during engine operation. Two angled piston cooling jets may be coupled to the feed body to supply cooling oil from the feed body to an oil gallery housed within a piston. The piston cooling jets may include showerhead elements at the end pointing towards inlets of the piston oil gallery. The showerhead elements may comprise a central larger central aperture radially surrounded by a plurality of smaller, peripheral apertures. Due to the arrangement of apertures in the showerhead elements, oil pressure may build up in the showerhead element and oil from the feed body may be sprayed as a plurality of jets hence reducing deviation of overall spray entering the inlets to the oil gallery in a piston, and oil from the feed body may be uniformly sprayed over a larger surface area on the piston from the apertures on the showerhead element. By dispensing the cooling oil over a larger surface area of the piston, hot spots may be reduced and the engine components may be uniformed lubricated. By increasing oil pressure using a showerhead element for spraying oil, energy expenditure by a pump to build up oil pressure may be reduced. Two piston cooling jets may extend in radially opposite directions relative to the feed body to improve the distribution of oil from the feed body. The two cooling jets may point to two distinct areas of the same piston or two separate pistons. A U-shaped fastening element may be used to couple the feed body to a cylinder bore and maintain the position of the cooling jets relative to the piston.

With a compact, light-weight, and modular configuration, the cooling jet system may ensure adequate oil flow and velocity above a non-zero threshold pressure with minimum flow diversion, thereby provide adequate cooling to the pistons at all operating condition while reducing component cost and complexity.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF FIGURES

The present invention will be better understood from reading the following description of non-limiting embodiments, with reference to the attached drawings, wherein below:

DETAILED DESCRIPTION

Figure 1:
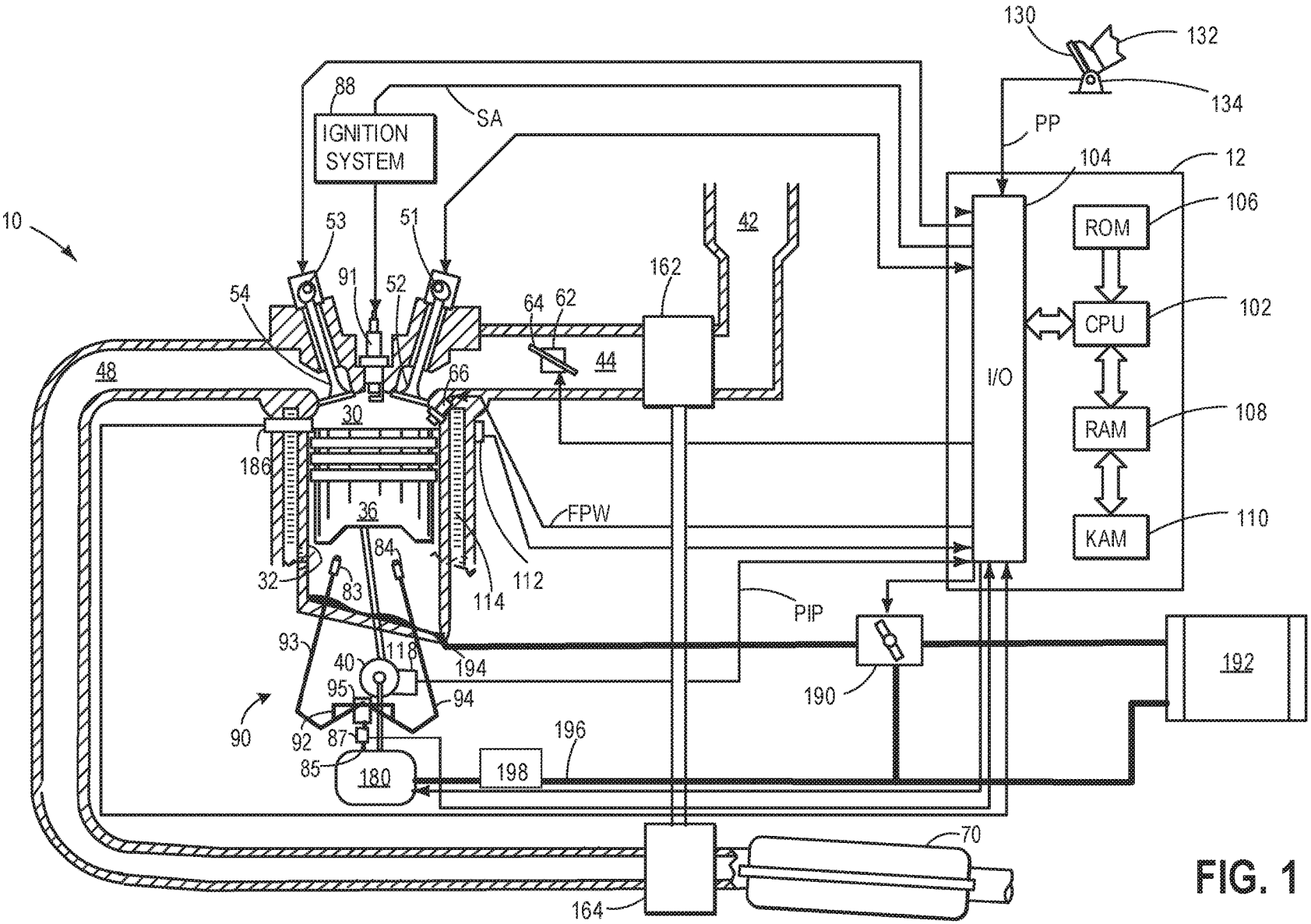
FIG. 1 shows an example engine system of a vehicle with an associated piston cooling jet system.

FIG. 1 is a schematic diagram showing one cylinder of multi-cylinder engine 10, which may be included in a propulsion system of a vehicle. In one example, the engine 10 may be a locomotive engine. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. It may also include a cabin temperature control device such as a thermostat control (not shown). The engine 10 may include a multiplicity of cylinders each with a combustion chamber 30 including combustion chamber walls 32 with piston 36 positioned therein. The reciprocation motion of piston 36 may be translated into rotational motion of a crankshaft via mechanical coupling. Crankshaft 40 may be coupled to at least one drive wheel of a vehicle via an intermediate transmission system.

Air for combustion may be delivered to combustion chamber 30 by way of an intake manifold 44 via intake passage 42 and may be exhausted after combustion via exhaust passage 48. Intake manifold 44 and exhaust passage 48 can selectively be coupled to combustion chamber 30 via respective intake valve 52 and exhaust valve 54. Combustion chamber 30 may include two or more intake valves and/or exhaust valves (not shown).

Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary intake valve 52 and exhaust valve 54 position.

Engine 10 may further include a compression device such as a turbocharger or supercharger including compressor 162 coupled to intake manifold 44. For a turbocharger, compressor 162 may be, in some part, driven by a turbine 164 coupled to an exhaust passage 48. For a supercharger, compressor 162 may be at least partially driven by the engine and/or an electric machine, and may not include a turbine. The amount of intake air compression via a turbocharger or supercharger may be varied by controller 12.

Fuel injector 66 may be mounted in the side of the combustion chamber or in the top of the combustion chamber and may directly inject fuel into combustion chamber 30 in proportion to the pulse width of signal FPW received from controller 12 in a manner known as direct injection. Alternatively or additionally a fuel injector may be arranged in intake manifold 44 and inject fuel into the intake port upstream of combustion chamber 30.

Intake passage 42 may include a throttle 62 having a throttle plate 64 and varied by controller. In this manner, throttle 62 may be operated to vary the intake air provided for combustion. Ignition system 88 may provide an ignition spark for combustion via spark plug 91 actuated by controller 12 and may be varied in response to operating conditions.

Variable flow oil pump 180 may be coupled to crankshaft 40 to derive power. Variable flow oil pump 180 may include a plurality of internal rotors (not shown) that are eccentrically mounted and actuated by controller 12 to change the position relative to one or more other rotors thereby adjusting output pressure. For example, the electronically controlled rotor may be coupled to a rack and pinion assembly that is adjusted via the controller 12.

It will be appreciated that any suitable variable flow oil pump configuration may be implemented to vary the oil pressure and/or oil flow rate. In some embodiments, instead of being coupled to the crankshaft 40 the variable flow oil pump 180 may be coupled to a camshaft, or may be powered by a different power source, such as a motor or the like.

A piston jet cooling system 90 may be coupled to the oil pump 180 to spray oil to an oil gallery formed within the piston 36 for engine cooling and lubrication. In one example, the oil gallery may be a hollow tubular structure formed within the cylindrical walls of the piston. The oil gallery may be a concentric with the central axis of the piston and may extend along the walls of the piston. In another example, the oil gallery may include a plurality of interconnected channels housed within the thickness of the piston wall. The piston oil gallery may include one or more inlet openings and outlet openings. Lubricating oil from the piston cooling jet system 90 may enter the oil gallery via the inlets and after circulation through the piston walls may exit the oil gallery via the outlets. Furthermore, through reciprocation of piston 36, oil is drawn up into combustion chamber 30 to provide cooling effects and lubrication to walls of the combustion chamber 30. The cooling jet system 90 may include a feed body 95 which receives oil from the oil pump via oil supply line 85 coupling the output of the pump 180 and the feed body 95. A pressure sensor 87 may be coupled to the oil supply line 85 to estimate the pressure of oil being supplied to the cooling jet system. A valve (not shown) may be positioned in the oil supply line 85 to activate or deactivate piston cooling in response to pressure from oil pump 180.

A fastening element 92 may be coupled to the feed body 95 to support two piston cooling tubes. A first piston cooling tube 93 may radially protrude from one side of the feed body 95 while a second piston cooling tube 94 may radially protrude from an opposite side of the feed body 95. A first showerhead structure 83 may be coupled to the first piston cooling tube 93 to spray cooling oil to a first side of the piston 36 while a second showerhead structure 84 may be coupled to the second piston cooling tube 94 to spray cooling oil to a second, opposite, side of the piston. In this way, the feed body 95 may be coupled to a piston oil gallery housed within a piston and the first showerhead outlet element of the first cooling tube 93 may protrude towards a first inlet of the piston oil gallery, and wherein the second showerhead outlet element of the second cooling tube 94 may protrude towards a second inlet of the piston oil gallery, the first inlet located on a first side of the piston oil gallery relative to a central axis of the piston stem, the second inlet located on a second, opposite side of the piston oil gallery relative to the central axis. In an alternate embodiment, the feed body 95 may be coupled in between a first piston oil gallery housed within a first piston and a second piston oil gallery housed within a second piston, and wherein the showerhead outlet element of the first cooling tube 93 may protrude towards an inlet of the first piston oil gallery, and the showerhead outlet element of the second cooling tube 94 may protrude towards an inlet of the second piston oil gallery. In one example, the feed body may be cylindrical. In another example, the feed body may be polygonal with three or more sides. Details of the cooling jet system 90 is elaborated in relation to FIGS. 2-8.

Vibration sensor 186 is shown positioned in combustion chamber wall 32 and may provide an indication of vibration in the combustion chamber to the controller 12. The vibration sensor 186 may be used to determine an indication of pre-ignition or engine knock in the combustion chamber 30. The indication of pre-ignition may be determined from larger vibrations that occurring earlier in the engine cycle (prior to spark) and the indication of engine knock may be determined from smaller vibrations that occur later in the engine cycle (subsequent to spark). Although a vibration sensor is provided as an example to determine an indication of pre-ignition and/or engine knock, it will be appreciated that any suitable sensor may be used to provide an indication of pre-ignition or engine knock.

An emission control device 70 is shown arranged along exhaust passage 48. Device 70 may be a three way catalyst (TWC), NOx trap, various other emission control devices, or combinations thereof.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air; a profile ignition pickup signal from Hall effect sensor 118 (or other type) coupled to crankshaft 40; throttle position from a throttle position sensor; and absolute manifold pressure signal. Engine speed signal, RPM, may be generated by controller 12.

Storage medium read-only memory 106 can be programmed with computer readable data representing instructions executable by processor 102 for performing the methods described herein as well as other variants that are anticipated but not specifically listed.

Furthermore, controller 12 may receive signals that may be indicative of pre-ignition or engine knock in the combustion chamber 30. For example, engine coolant temperature from temperature sensor 112 coupled to water jacket 114 may be sent to controller 12 to indicate whether or not the temperature of the combustion chamber is in range in which pre-ignition may occur. Controller 12 may adjust oil injection in response to an indication of pre-ignition that includes an engine temperature being greater than a threshold. Additionally or alternatively, vibration sensor 186 may send a signal indicating pre-ignition in response to detecting vibrations that correspond a vibration profile of pre-ignition (e.g., higher amplitude, occur earlier in the engine cycle, etc.). Controller 12 may receive an indication of oil pressure from pressure sensor 87 positioned downstream of the output of the variable flow oil pump 180.

In accordance with one embodiment of the invention, it is possible to take into consideration the situation that the moment of ignition, in which knocking, i.e. an uncontrolled combustion or self-ignition of the fuel occurs, in other words, the so-called borderline ignition setting (BDL), is dependent upon the piston temperature. It is possible by suitably activating the piston jet cooling system 90 to cool the piston 36 and to achieve a displacement of the moment of ignition by at least 1 degree, in particular by at least 2 degrees, of crank angle, whereby in turn fuel efficiency is improved.

In accordance with one embodiment, based on a demand to warm up the passenger internal compartment of the motor vehicle, the controller may selectively activate or deactivate the piston jet cooling system 90. The heating of a passenger compartment may be initiated by operator input 104 via control system 12. The control system 12 may actuate a thermostat 190 that controls the flow of heated oil to a heating core 192 wherein the heated oil is coupled to oil pan 194 collecting oil that has been previously sprayed onto piston 36 by the piston jet cooling system 90. From the heater core 192 or directly from the thermostat 190, the oil may return to an oil sump 198 where the oil is stored before being pumped to the cooling jet system 90.

Figure 2:
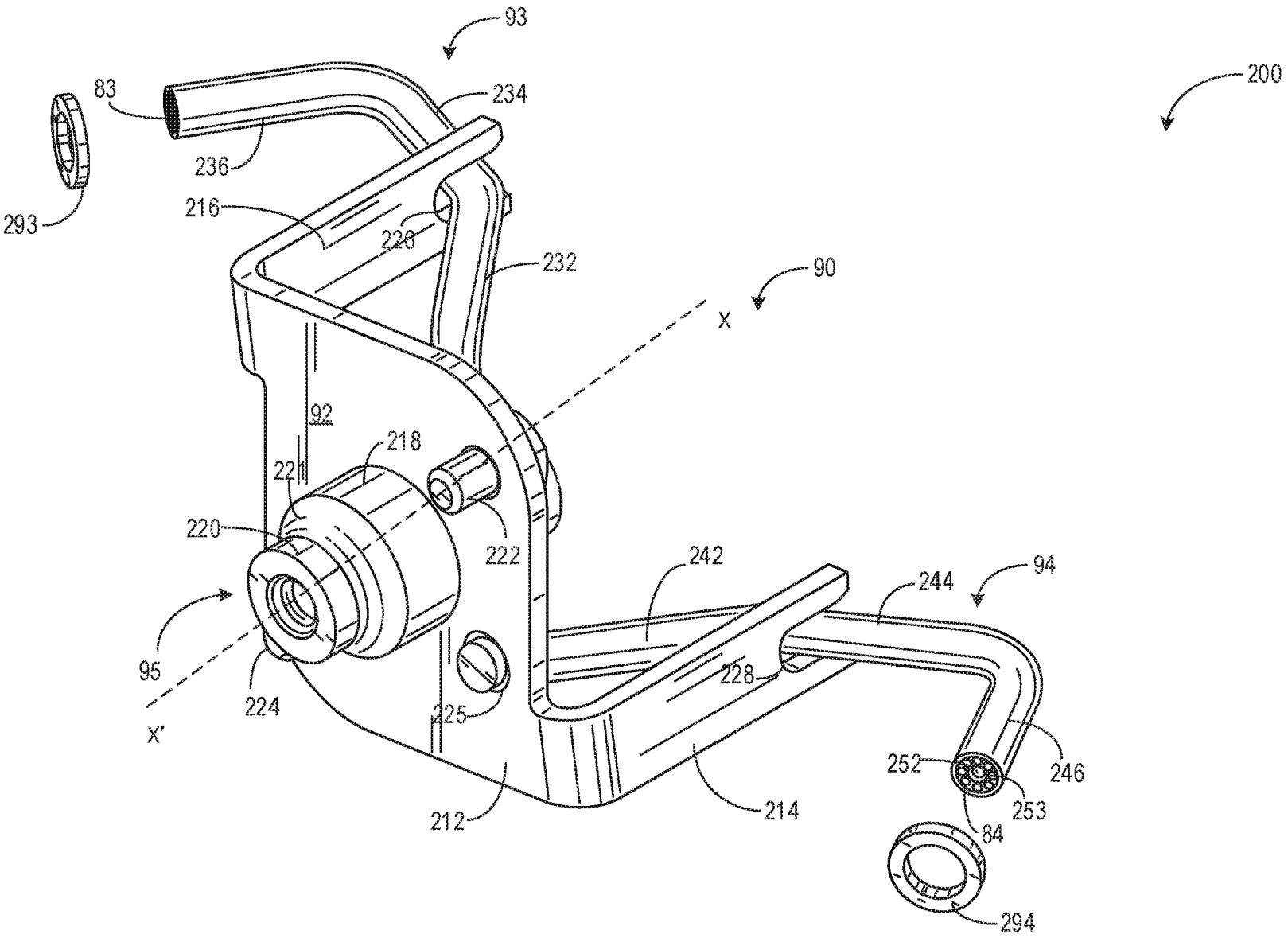
FIG. 2 shows an isometric view of a piston cooling jet system according to the present disclosure.

FIG. 2 shows an isometric view 200 of a piston cooling jet system 90 of FIG. 1. Components already introduced in FIG. 1 are numbered similarly and not re-introduced. The piston cooling jet system 90 may include a feed body 95 coupling an oil pump (such as oil pump 180 in FIG. 1) to each of a first piston cooling tube 93 and a second piston cooling tube 94. A fastening element 92 may be coupled to the feed body 95 to support two piston cooling tubes of the piston cooling jet system 90 and to couple the piston cooling tubes to an engine block. The piston cooling jet system 90 may deliver lubricating oil to an oil gallery housed within the piston. Openings 293 and 294 denote two separate inlets to a feed gallery of a piston. In one example, each of the two inlets 293 and 294 lead to a single oil gallery housed within a single piston. In another example, each of the two inlets 293 and 294 lead to two distinct oil galleries coupled to separate pistons.

The feed body 95 may be a cylindrical structure radially symmetrical around a central axis X-X'. The feed body 95 may be positioned within a central circular recess formed on a first surface 212 of the fastening element 95 with a first portion protruding out from a upper side of the first surface 212 and a second portion (not shown in this view) protruding from a lower, opposite, side of the first surface 212. The first portion may include a first cylindrical ring 218 adjoining the first surface 212, a ramp 221, and a second cylindrical ring 220, protruding outwards along the central axis X-X'. The diameter of the first cylindrical ring may be bigger than the diameter of the second cylindrical ring 224.

The fastening element 92 may include the first surface 212 (also referred herein as plate), a second surface 216 (also referred herein as first support arm) perpendicular to the first surface 212, and a third surface 214 (also referred herein as second support arm) perpendicular to the first surface 212 and parallel to the second surface 216. Said another way, a first support arm 216 may extend upwards from a first corner of the plate 212 and a second support arm 214 may extend upwards from a second, diagonally opposite corner of the plate 212. The first surface 212 may be of rectangular shape with rounded edges. The second surface 216 may extend along the lower side of the first surface 212 from a first edge of the rectangular first surface 212. The third surface 214 may extend along the lower side of the first surface 212 from a second edge of the rectangular first surface 212, the second edge diagonally opposite to the first edge. Each of the second surface 216 and the third surface 214 may be rectangular shaped and parallel to the central axis X-X'.

The fastening element 92 may be coupled to the engine (cylinder) bore via a pair of fasteners 222 and 224 on the first surface 212 of the fastening element. A first fastener 222 may include a bolt fastened through a corresponding first opening in the first surface 212 and secured with internal thread on the engine block while a second fastener 224 may include a bolt fastened through a corresponding second opening in the first surface 212 and secured with internal thread on the engine block. The first opening and the second opening may be positioned on diagonally opposite sides of the central recess with the first opening proximal to a third edge of the rectangular first surface 212 and the second opening proximal to a fourth edge of the rectangular first surface 212. A dowel pin 225 may be positioned within an opening on the fastening element and together with the first cylindrical ring 218, dowel pin 225 may help in aligning the orientation piston cooling jet system 90 such that showerhead structure 83 and 84 may feed to oil gallery in piston 36 via the inlets 293 and 294.

An end of the second surface 216, distal from the first surface 212, may include a first oval recess 226 (also referred to herein as a first notch) while an end of the third surface 214, distal from the first surface 212, may include a second oval recess 228 (also referred to herein as a second notch). A first piston cooling tube 93 may radially protrude from one side of the feed body 95 while a second piston cooling tube 94 may radially protrude from another side of the feed body 95, relative to the central axis X-X'. The first piston cooling tube 93 and the second piston cooling tube 94 may be offset from one another. In one example, the first piston cooling tube 93 and the second piston cooling tube 94 may be offset by 30°. In another example, the first piston cooling tube 93 and the second piston cooling tube 94 may be diametrically opposite to each other. The first piston cooling tube 93 may be tack welded to the first oval recess 226 while the second piston cooling tube 94 may be tack welded to the second oval recess 228. The first piston cooling tube 93 may include a first portion 232 coupled to the feed body 95, a second portion 234, a third portion 236, and a first showerhead structure 83 positioned at an end of the third portion facing the inlet 293 of the oil gallery in a piston. Each of the first portion 232, the second portion 234, and the third portion 236 leading to the first showerhead structure 83 may be hollow allowing oil to flow from the feed body 95 to the first showerhead structure 83. The second piston cooling tube 94 may include a first portion 242 coupled to the feed body 95, a second portion 244, a third portion 246, and a second showerhead structure 84 positioned at an end of the third portion 246 facing the inlet 294 of the oil gallery in a piston. Also, each of the first portion 242, the second portion 244, and the third portion 246 leading to the second showerhead structure 84 may be hollow allowing oil to flow from the feed body 95 to the second showerhead structure 84. Each of the first showerhead structure 83 and the second showerhead structure 84 may include a larger central aperture 252 radially surrounded by a plurality of smaller, peripheral apertures 253. By arranging apertures in a concentric circular design, oil pressure may build up in the showerhead element and oil from the feed body may be sprayed as multiple small jets hence reducing diversion of overall spray and increasing oil catchment at the inlets to the oil gallery in a piston. The showerhead design may also facilitate in maintaining jet velocity. Details of the first piston cooling tube 93 and the second piston cooling tube 94 will be discussed in relation to FIG. 5.

Figure 3:
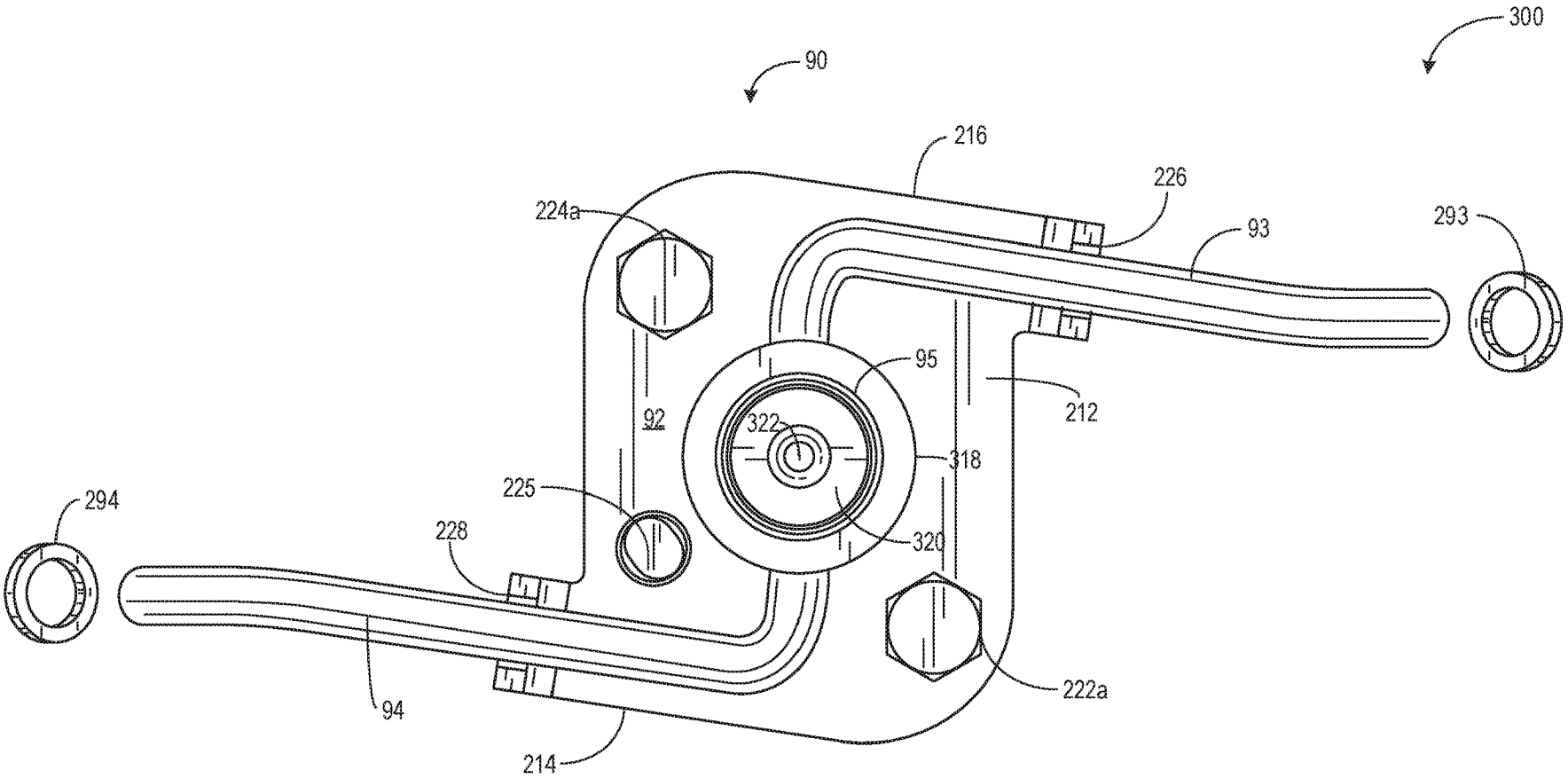
FIG. 3 shows a bottom view of the piston cooling jet system of FIG. 1.

FIG. 3 shows a bottom view 300 of the piston cooling jet system 90 of FIG. 1. Components already introduced in previous figures are numbered similarly and not re-introduced. The lower side of the first surface 212 of the fastening element 92 is seen with the feed body 95 housed at the center of the fastening element 92. The second portion of the feed body 95 protrudes downwards (away from the piston) from the lower side of the first surface 212. The second portion may include a hollow bore 322 connecting the feed body 95 to an oil supply line 85 through which oil from the sump may be delivered to the cooling tubes. The hollow bore 322 may be enclosed within a third cylindrical ring 318 and a fourth cylindrical ring 320. In one example, each of the hollow bore 322, the third cylindrical ring 318, and the fourth cylindrical ring 320 may be concentric with a central axis.

The second surface 216 of the fastening element 92 and the third surface 214 of the fastening element extend downward from the first surface 212, diagonally opposite to each other. The first piston cooling tube 93 and the second piston cooling tube 94 project outward from the feed body 95 in opposite directions. Each of the first piston cooling tube 93 and the second piston cooling tube 94 may be bent with the showerhead outlet elements facing upwards towards the piston. As the first piston cooling tube 93 is confined within the first oval recess 226 and the second piston cooling tube 94 is confined within the second oval recess 228, each of the first piston cooling tube 93 and the second piston cooling tube 94 may be held in place relative to the fastening element 92.

The corresponding mating internal threads in engine block for each of the fasteners 222 and 224 may be positioned atop and in contact with the lower side of the first surface 212.

Figure 4:
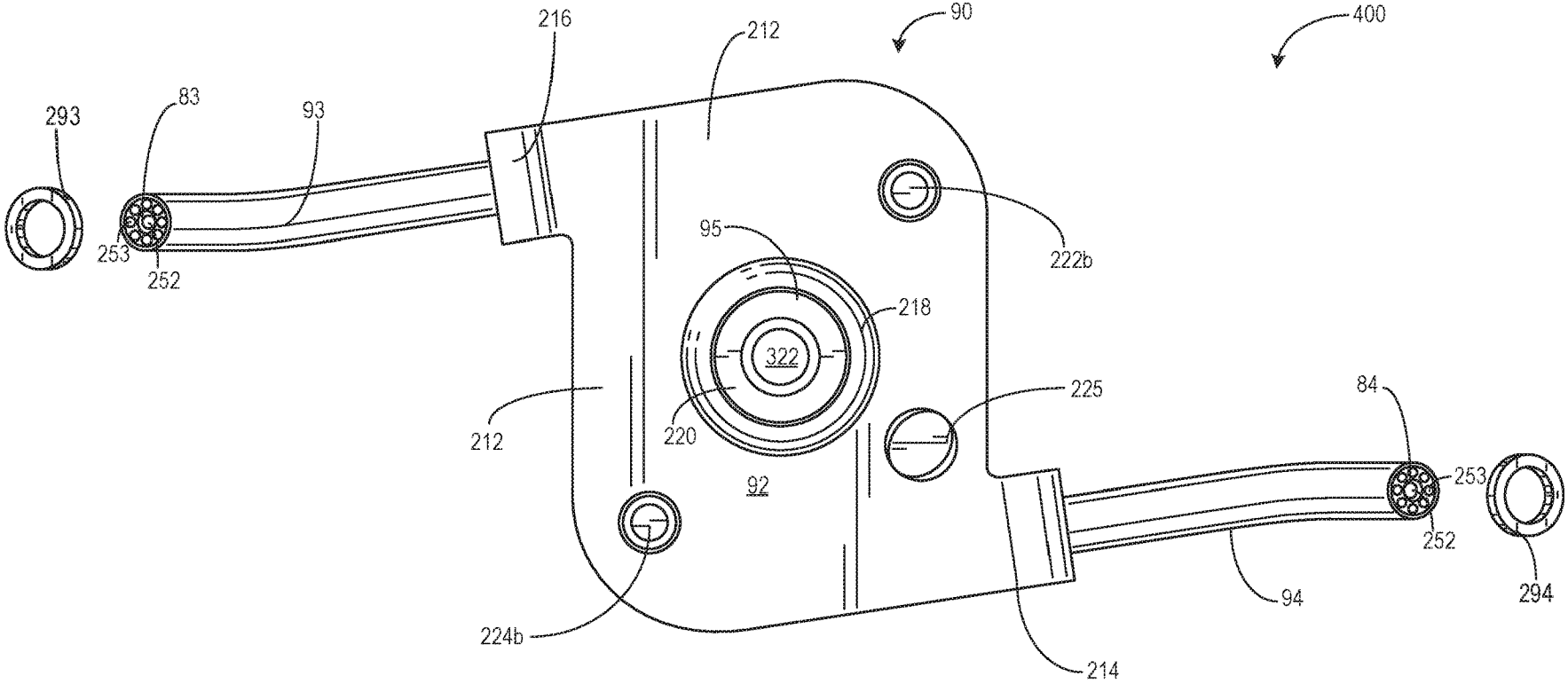
FIG. 4 shows a top view of the piston cooling jet system of FIG. 1.

FIG. 4 shows a top view 400 of the piston cooling jet system 90 of FIG. 1. Components already introduced in previous figures are numbered similarly and not re-introduced. The upper side of the first surface 212 of the fastening element 92 is seen with the feed body 95 housed at the center of the fastening element 92. The first portion of the feed body 95 protrudes upwards and outwards (towards the piston) from the upper side of the first surface 212. The first portion may include a hollow bore 322 enclosed within a first cylindrical ring 218 and a second cylindrical ring 220. In one example, each of the hollow bore 322, the first cylindrical ring 218, and the second cylindrical ring 220 may be concentric with a central axis.

The second surface 216 of the fastening element 92 and the third surface of the fastening element 214 extend downward from the first surface 212, diagonally opposite to each other. The first piston cooling tube 93 and the second piston cooling tube 94 project outward (towards the piston) from the feed body 95.

Each of the first piston cooling tube 93 and the second piston cooling tube 94 may be bent with the showerhead structures 83 and 84 facing upwards towards the piston. Each of the showerhead structures 83 and 84 include a larger central aperture 252 radially surrounded by a plurality of smaller, peripheral apertures 253. In one example, each showerhead element may include 8 peripheral apertures. Each of the peripheral apertures may have an equal diameter while the central aperture may have a larger diameter relative to the peripheral apertures. By including a showerhead element, oil pressure may build up in the showerhead element and oil from the feed body may be sprayed as multiple small jets hence reducing diversion of overall spray and increasing oil catchment at the inlet to oil gallery in a piston, thereby improving cooling and lubricating capabilities of the sprayed oil.

The corresponding ends of the bolts for each of the fasteners 222 and 224 are projecting downwards from the second surface 212 of the fastening element 92. The bolts may attach the fastening element 92 to an engine bore via internal threads on engine block.

Figure 5:
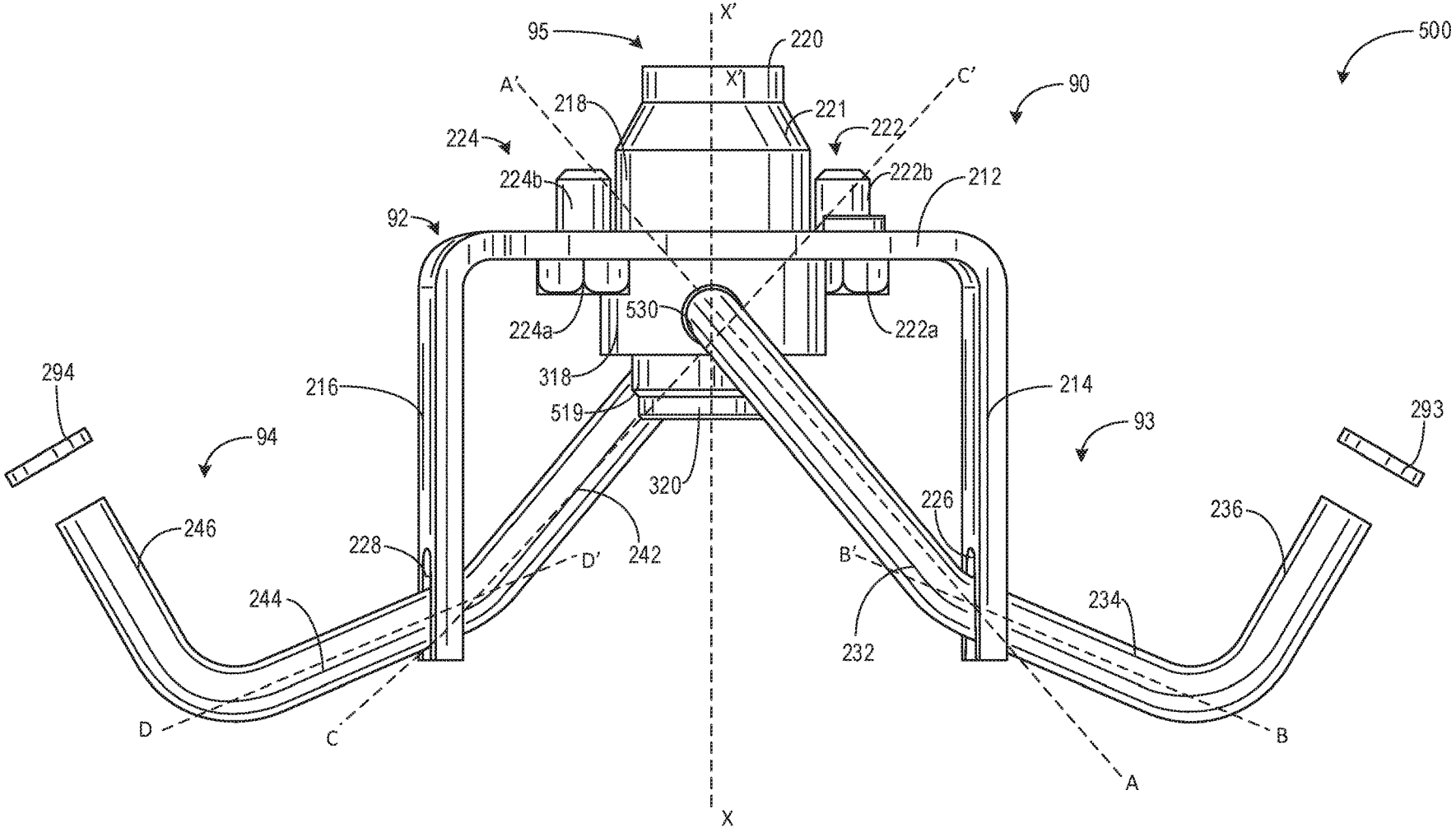
FIG. 5 shows a front view of the piston cooling jet system of FIG. 1.

FIG. 5 shows a front view 500 of the piston cooling jet system 90 of FIG. 1. Components already introduced in previous figures are numbered similarly and not re-introduced. Oil may be supplied from an oil sump to the piston cooling jet system 90 via a feed body 90 and the piston cooling jet system 90 may be coupled to the engine bore via a fastening element 95.

The feed body 95 may be a cylindrical structure radially symmetrical around a central axis X-X'. The feed body 95 may be divided into a first portion protruding upwards (along central axis) from a first surface 212 of the fastening element 92, and a second portion protruding downwards (along central axis) from the first surface 212 of the fastening element 92. The central portion of the feed body 95 may be cylindrical while each end may be tapering. The first portion may include a first cylindrical ring 218 adjoining the first surface 212, a ramp 221, and a second cylindrical ring 220 and the second portion may include a third cylindrical ring 318, and a fourth cylindrical ring 320, and a flange 519 including a ramp connecting the third cylindrical ring 318 to the fourth cylindrical ring 320. The first cylindrical ring 218 may be coupled to the third cylindrical ring 318 at the fastening element 92 via threading formed on an inner surface of the third cylindrical ring 318.

The fastening element 92 may be an inverted U-shaped structure including a first surface 212 (base of the U-shape), a second surface 216 (one side of the U-shape) perpendicular to the first surface, and a third surface 214 (other side of the U-shape) perpendicular to the first surface and parallel to the second surface 216. The first surface 212 may be fastened to the engine bore via two fasteners 222 and 224. The first fastener 222 may include a bolt fastened through a corresponding first opening in the first surface 212 and secured with internal threads on engine block while a second fastener 224 may include a bolt fastened through a corresponding second opening in the first surface 212 and secured with internal threads on engine block.

A first piston cooling tube 93 may radially protrude from a first aperture 530 on a front side of the central cylindrical portion of the feed body 95. The first cooling tube 93 may include a first section 232 protruding laterally outwards from one side of the central cylindrical region of the feed body along a first longitudinal axis A-A', a second section 234 extending from the first section along a second longitudinal axis B-B', and a showerhead element 236 extending upwards from the second section. The first section 232 may extend in a direction away from the piston while the showerhead element 236 may extend towards the inlet 293 of the piston oil gallery onto which oil may be sprayed from a showerhead structure positioned at the end of the showerhead element 236. Each of the first section 232, the second section 234, and the showerhead element 234 enclose hollow connected passages. In one example, hollow angled connector passages may connect the first section 232 to the second section 234, and the second section 234 to the showerhead element 236.

The second section 234 may extend laterally away from each of the central axis X-X' and the first longitudinal axis A-A' while the showerhead element 236 may extend laterally away from each of the central axis X-X', the first longitudinal axis A-A', and the second longitudinal axis B-B'. The first longitudinal axis A-A' may form a first angle with the central axis X-X'. In one example, the first angle may be in a range between 30 degrees and 90 degrees. The first longitudinal axis A-A' may form a second angle with the second axis B-B'. In one example, the second angle may be in a range between 110 degrees and 170 degrees. The showerhead element 236 may make a right angle to the second axis B-B' (e.g., a central axis of the showerhead element may be at a right angle to the second axis, or it may otherwise be angled, at a non-zero degree angle, relative the second axis).

A second piston cooling tube 94 may radially protrude from a second aperture (obstructed in this view) on a back side of the feed body 95. The second aperture may be positioned on the feed body 95 diagonally opposite to the first aperture 50. The second cooling tube 94 may include a first section 242 protruding laterally outwards from one side of the central cylindrical region of the feed body along a third longitudinal axis C-C', a second section 244 extending from the first section 242 along a fourth longitudinal axis D-D', and a showerhead element 246 extending upwards from the second section 244. The first section 242 may extend in a direction away from the piston while the showerhead element 246 may extend towards the inlet 294 of the piston oil gallery onto which oil may be sprayed from a showerhead structure positioned at the end of the showerhead element 246. Each of the first section 242, the second section 244, and the showerhead element 234 enclose hollow connected passages. In one example, hollow angled connector passages may connect the first section 242 to the second section 244, and the second section 244 to the showerhead element 246.

The second section 244 may extend laterally away from each of the central axis X-X' and the third longitudinal axis C-C' while the showerhead element 246 may extend laterally away from each of the central axis X-X', the third longitudinal axis C-C', and the fourth longitudinal axis D-D'. The third longitudinal axis C-C' may form the first angle with the central axis X-X'. In one example, the first angle may be in a range between 30 degrees and 90 degrees. The third longitudinal axis C-C' may form the second angle with the fourth axis D-D'. In one example, the second angle may be in a range between 110 degrees and 170 degrees. The showerhead element 246 may make a right angle to the fourth axis D-D' (e.g., a central axis of the showerhead element may be at a right angle to the fourth axis, or it may otherwise be angled, at a non-zero degree angle, relative the fourth axis). The first longitudinal axis A-A' may form a third angle with the third longitudinal axis C-C'. In one example, the third angle may be in a range between 90 degrees and 150 degrees.

In this way, a feed body may receive oil from an oil sump and dispense oil to a cylinder piston, the feed body having a central cylindrical region with a central axis, a tapered upper end and a tapered bottom end; a first cooling tube having a first section extending upwards and protruding laterally outwards from one side of the central cylindrical region of the feed body along a first longitudinal axis, and a second section extending from the first section along a second longitudinal axis, the second axis at a first angle relative to the first axis, the first axis at a second angle relative to the central axis; and a second cooling tube having the first section extending upwards and protruding laterally outwards from another side of the central cylindrical region of the feed body along a third longitudinal axis, and the second section extending from the first section along a fourth longitudinal axis, the fourth axis at the first angle relative to the third axis, the third axis at the second angle relative to the central axis, wherein an outlet of the second section of each of the first and second cooling tube has a large aperture surrounded circumferentially by a plurality of smaller apertures.

Figure 6:
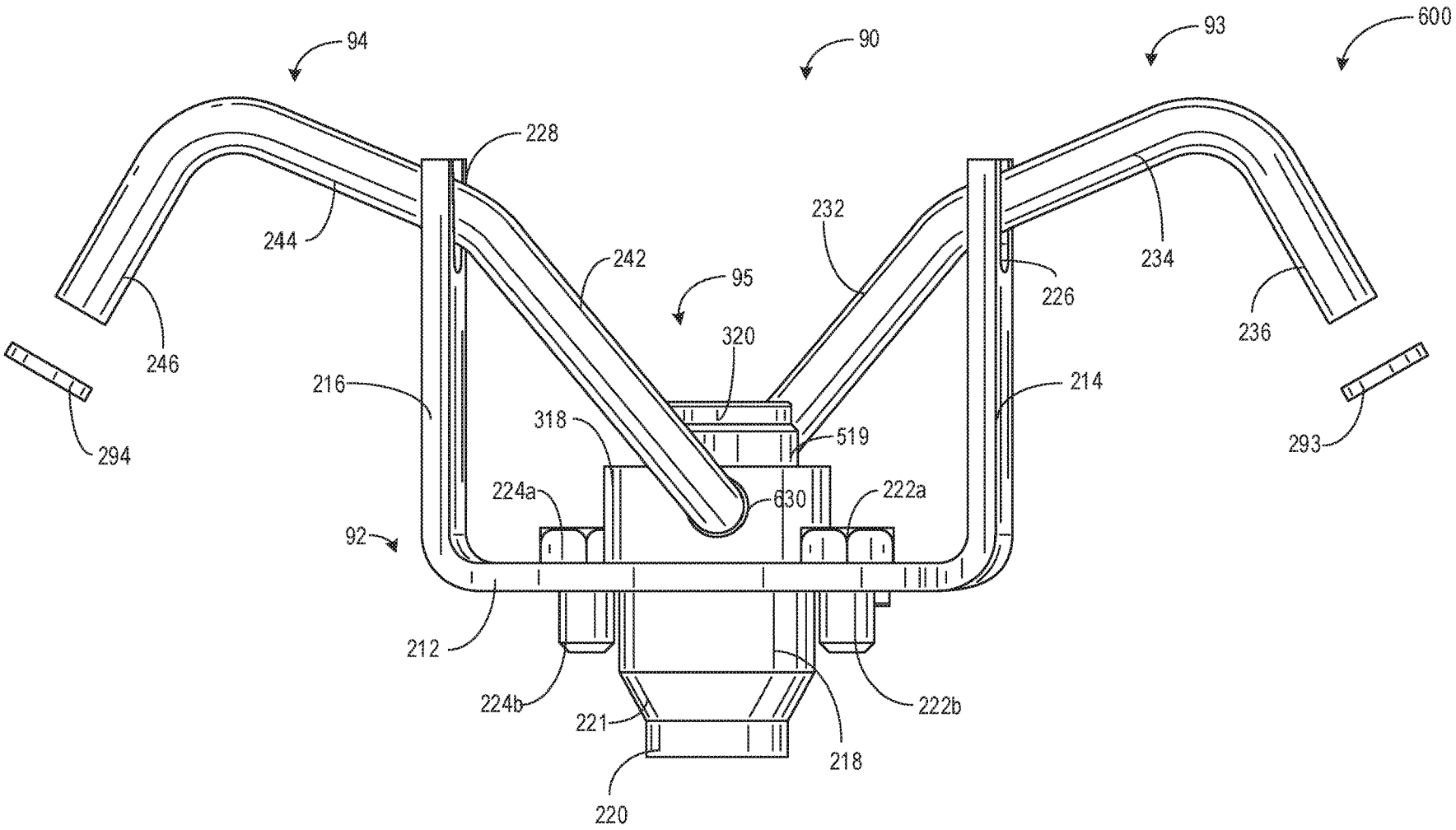
FIG. 6 shows a rear view of the piston cooling jet system of FIG. 1.

FIG. 6 shows a back view 600 of the piston cooling jet system 90 of FIG. 1. Components already introduced in previous figures are numbered similarly and not re-introduced. Oil may be supplied to a piston cooling jet system 90 via a feed body 95 hydraulically coupled to an oil reservoir. The feed body 95 may also be coupled to a bottom surface of a cylinder bore via a fastening element 95, the cylinder bore housing the piston.

As previously discussed, the radially symmetric, cylindrical feed body may include a first cylindrical ring 218, a ramp 221, a second cylindrical ring 220, a third cylindrical ring 318, a flange 519 including a ramp, and a fourth cylindrical ring 320 (coupled in this order).

The fastening element 92 is seen as a U-shaped structure including a first surface 212, a second surface 216 perpendicular to the first surface, and a third surface 214 perpendicular to the first surface and parallel to the second surface 216. The first surface 212 may be fastened to the engine bore via two fasteners 222 and 224.

A first piston cooling tube 93 may radially protrude from a first aperture (obstructed in this view) on a front side of the feed body 95. A second piston cooling tube 94 may radially protrude from a second aperture 630 on a back side of the central cylindrical portion of the feed body 95. The first and second apertures may be positioned diagonally opposite to each other on the third cylindrical ring 318 of the feed body 95. A first longitudinal axis of the first cooling tube 93 may be at an angle relative to the longitudinal axis X-X' of the feed body 95 on a side of the feed body, and the second longitudinal axis of the second cooling tube 94 may be at the same angle relative to the longitudinal axis X-X' of the feed body 95 on another side of the feed body. Each of the first piston cooling tube 93 and the second piston cooling tube 94 may include a showerhead outlet element at respective ends of the tubes 93 and 94 distal from the feed body 95. The showerhead outlet element of the first tube 93 may be angled relative to the first longitudinal axis of the first cooling tube 93, and wherein the outlet element of the second tube 94 may be angled relative to the second longitudinal axis of the second cooling tube 94. The first showerhead element of the first cooling tube 93 may extend laterally away from each of the longitudinal axis of the first cooling tube 93 and the longitudinal axis X-X' of the feed body 95, and the second showerhead element of the second cooling tube 94 may extend laterally away from each of the longitudinal axis of the second cooling tube 94 and the longitudinal axis X-X' of the feed body. The first showerhead element and the second showerhead element may be offset from one another. In one example, the first showerhead element and the second showerhead element may be offset by 30°. In another example, the first showerhead element and the second showerhead element may be diametrically opposite to each other.

In this way, the components of the above mentioned figures enable a system, comprising: a plate having a central aperture, a first support arm extending upwards from a first corner of the plate and a second support arm extending upwards from a second, diagonally opposite corner of the plate, each of the first and second support arms having a notch at an outer edge, a cylindrical oil feed body coupled in the central aperture such that a first portion of the feed body lies above a plane of the plate, and a second, remaining portion of the feed body lies below the plane of the plate, a first segmented tube protruding laterally from a first side of the first portion of the feed body, the first segmented tube including a first segment extending into and beyond the notch of the first support arm, and a second segment extending radially away from the notch of the first support arm, an outlet of the first support arm having a showerhead structure, and a second segmented tube protruding laterally from a second side, opposite the first side, of the first portion of the feed body, the second segmented tube having a third segment extending into and beyond the notch of the second support arm, and a forth segment extending radially away from the notch of the second support arm.

Figure 7:
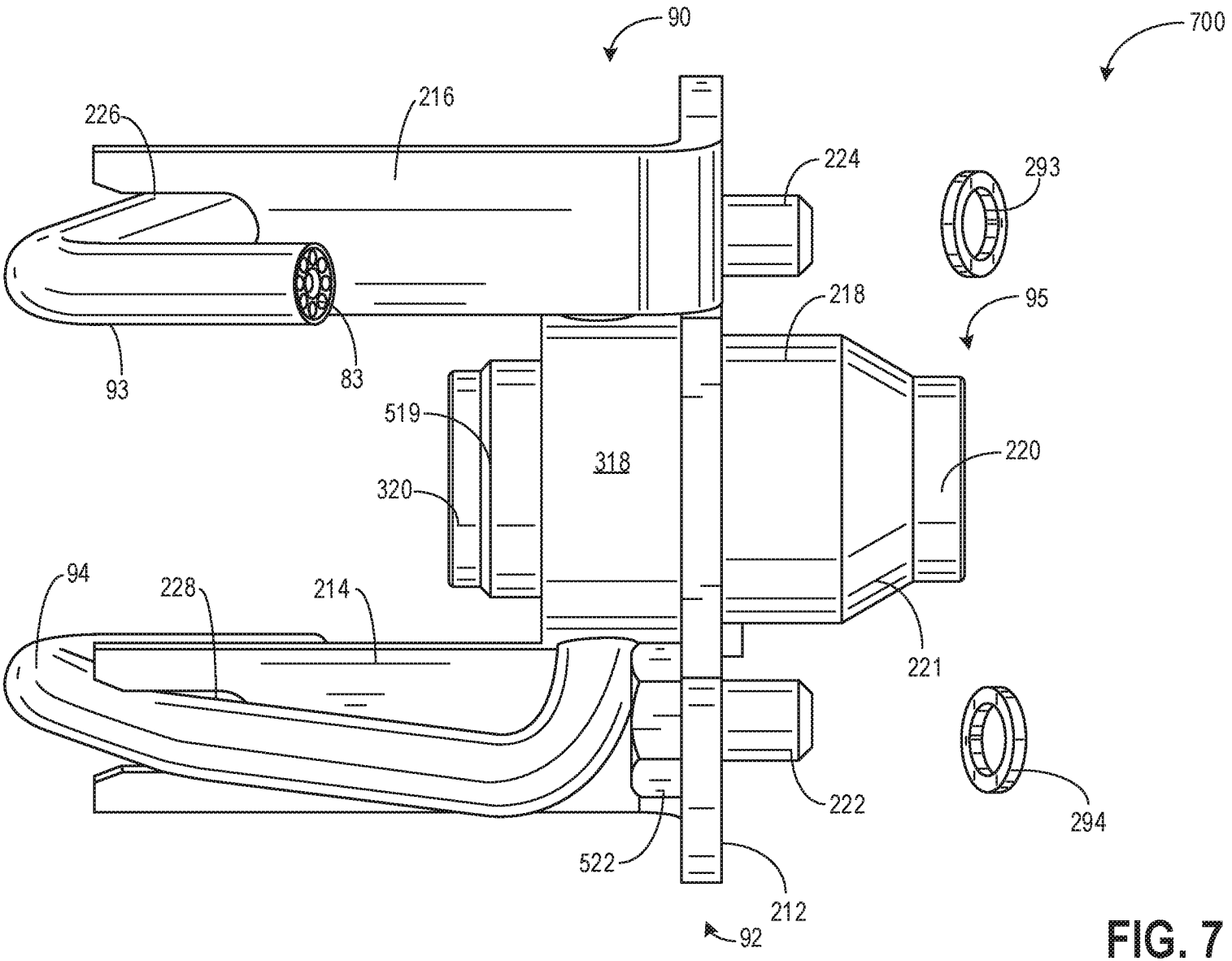
FIG. 7 shows a left view of the piston cooling jet system of FIG. 1.
Figure 8:
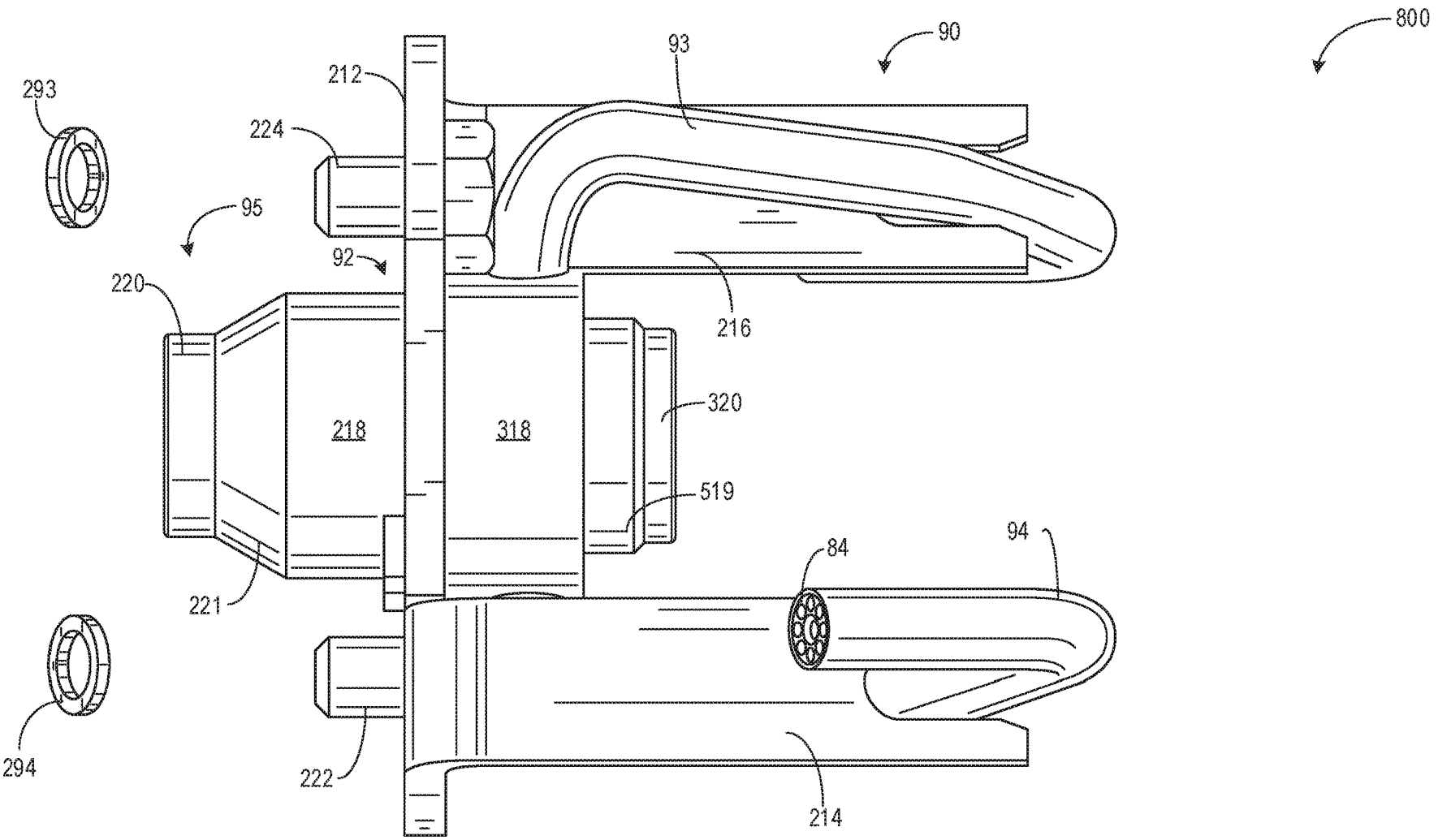
FIG. 8 shows a right view of the piston cooling jet system of FIG. 1.

FIG. 7 shows a left view 700 of the piston cooling jet system 90 of FIG. 1 while FIG. 8 shows a right view of the piston cooling jet system 90 of FIG. 1. Components already introduced in previous figures are numbered similarly and not re-introduced. The cooling system may spray oil to underside plurality of inlets of a piston oil gallery via a plurality of cooling tubes each pointing at piston specific inlet of the oil gallery.

As previously described, the piston cooling jet system 90 includes a feed body 95 which is coupled to an engine cylinder bore via a fastening element 92. The fastening element 92 may include a first surface through which the feed body 95 is threaded and two bracket like surfaces 216 and 214 (second surface and third surface) parallel to each other and perpendicular to the first surface, the second surface and the third surface. A first recess 226 is formed at the end of the second surface 216 to support a first cooling tube 93 protruding (from the wall of the feed body 95) towards the left side of the piston. Similarly, a second recess 228 is formed at the end of the third surface 214 to support a first cooling tube 93 protruding (from the wall of the feed body 95) towards the right side of the piston. By having cooling tubes supply oil to different portions of the piston, a uniform distribution of cooling oil may be achieved on the piston, thereby providing a homogeneous cooling effect on the piston.

Each of the cooling tubes 93 and 94 may include a first showerhead structure to disperse the oil spray onto the piston. The first showerhead structure 83 pointing towards the left side of the piston (as seen in FIG. 7 and obstructed by the fastening element in FIG. 8) and the second showerhead structure 84 pointing towards the right side of the piston (as seen in FIG. 8 and obstructed by the fastening element in FIG. 7) may include a central, larger opening surrounded by a plurality of smaller openings. As the oil flows out of the cooling tubes through the plurality of openings, the pressure of the oil coming out of the cooling system increases.

In this way, by including cooling tubes protruding outwards and in radially opposite directions from a feed body, uniform distribution of cooling oil on the oil gallery inlets is improved. The technical effect of using a showerhead element at the end of a cooling tube is that the cooling oil may be dispersed over a larger surface area of the piston. By uniformly distributing oil over the piston, hot spots may be reduced and an overall cooling of the engine may be improved. Further, spray of oil onto the piston improves lubrication and reduces power losses caused by friction.

An example piston cooling system for an engine (e.g., a locomotive engine or an engine of another vehicle) comprises: a feed body hydraulically coupled to an oil reservoir, the feed body having a longitudinal axis, a first piston cooling tube extending laterally to protrude radially out from one side of the feed body relative to the longitudinal axis, the first tube having a first showerhead outlet element, and a second piston cooling tube extending laterally to protrude radially out from another, side of the feed body relative to the longitudinal axis, the second tube having a second showerhead outlet element. In any preceding example, additionally or optionally, the first showerhead outlet element is positioned diametrically opposite to the second showerhead outlet element and wherein each of the first showerhead outlet element and the second showerhead outlet element include a larger central aperture radially surrounded by a plurality of smaller, peripheral apertures. In any or all of the preceding examples, additionally or optionally, each of the first showerhead outlet element and the second showerhead outlet element of the first and second cooling tubes are coupled to a main passage of the corresponding first and second cooling tubes via an angled, hollow connector element. In any or all of the preceding examples, additionally or optionally, a first longitudinal axis of the first cooling tube is at an angle relative to the longitudinal axis of the feed body on the side of the feed body, and wherein a second longitudinal axis of the second cooling tube is at the same angle relative to the longitudinal axis of the feed body on the another side of the feed body. In any or all of the preceding examples, additionally or optionally, an angle defined by the first longitudinal axis and the second longitudinal axis is in a range between 30 degrees and 90 degrees. In any or all of the preceding examples, additionally or optionally, the first showerhead outlet element is angled relative to the first longitudinal axis of the first cooling tube, and wherein the second showerhead outlet element of the second tube is angled relative to the second longitudinal axis of the second cooling tube. In any or all of the preceding examples, additionally or optionally, the first showerhead outlet element extends laterally away from each of the longitudinal axis of the first cooling tube and the longitudinal axis of the feed body, and wherein the second showerhead outlet element extends laterally away from each of the longitudinal axis of the second cooling tube and the longitudinal axis of the feed body. In any or all of the preceding examples, additionally or optionally, the feed body is coupled to a piston oil gallery housed within a piston, and wherein the first showerhead outlet element protrudes towards a first inlet of the piston oil gallery, and wherein the second showerhead outlet element protrudes towards a second inlet of the piston oil gallery, the first inlet located on a first side of the piston oil gallery relative to a central axis, the second inlet located on a second, opposite side of the piston oil gallery relative to the central axis. In any or all of the preceding examples, additionally or optionally, the feed body is cylindrical and coupled in between a first piston oil gallery housed within a first piston and a second piston oil gallery housed within a second piston, and wherein the first showerhead outlet element protrudes towards an inlet of the first piston oil gallery, and the second showerhead outlet element protrudes towards an inlet of the second piston oil gallery. In any or all of the preceding examples, the piston cooling system further comprising, additionally or optionally, a fastening element having a first surface with a first circular recess for receiving the feed body, a second surface perpendicular to the first surface and having an oval recess through which the first cooling tube is supported, and a third surface perpendicular to the first surface and parallel to the second surface having another oval recess through which the second cooling tube is supported, the fastening element coupling the cooling system to an engine block via the first surface.

Another cooling system in an engine (e.g., a locomotive engine or engine for another vehicle), comprises: a feed body for receiving oil from an oil sump and dispensing oil to a cylinder piston, the feed body having a central cylindrical region with a central axis, a tapered upper end and a tapered bottom end, a first cooling tube having a first section extending upwards and protruding laterally outwards from one side of the central cylindrical region of the feed body along a first longitudinal axis, and a second section extending from the first section along a second longitudinal axis, the second axis at a first angle relative to the first axis, the first axis at a second angle relative to the central axis, and a second cooling tube having a first section extending upwards and protruding laterally outwards from another side of the central cylindrical region of the feed body along a third longitudinal axis, and a second section extending from the first section of the second cooling tube along a fourth longitudinal axis, the fourth axis at the first angle relative to the third axis, the third axis at the second angle relative to the central axis, wherein an outlet of the second section of each of the first and second cooling tubes has a large aperture surrounded circumferentially by a plurality of smaller apertures. In any preceding example, additionally or optionally, the first section of each of the first and second cooling tubes includes a first set of connected passages, wherein the second section of each of the first and second cooling tubes includes a second passage, the first section coupled to the second section via an angled connector passage. In any or all of the preceding examples, the system further comprising, additionally or optionally, a fastening element for fastening the cooling system to a cylinder bore, the fastening element having a first surface with a first circular recess for receiving the feed body, a second surface having a plane perpendicular to a plane of the first surface and having an oval recess supporting the first section of the first cooling tube, and a third surface having a plane perpendicular to the first surface and parallel to the second surface, the third surface having another oval recess supporting the first section of the second cooling tube, wherein the second section of the first cooling tube extends beyond the second surface and the second section of the second cooling tube extends beyond the third surface. In any or all of the preceding examples, additionally or optionally, the plane of the first surface further includes a pair of openings on either side of the first circular recess for receiving a bolt for coupling the fastening element to the cylinder bore. In any or all of the preceding examples, additionally or optionally, the pair of openings are positioned along a first diagonal axis of the plane of the first surface, and wherein the second and third surface extend from the plane of the first surface along a second diagonal axis, perpendicular to the first diagonal axis. In any or all of the preceding examples, additionally or optionally, the feed body is coupled to a bottom surface of a cylinder bore, the cylinder bore housing the cylinder piston including an oil gallery comprising a hollow tubular structure formed within piston walls, and wherein the outlet of the first cooling tube protrudes towards a first inlet of the oil gallery, and the outlet element of the second cooling tube protrudes towards a second inlet of the piston oil gallery, each of the first inlet and the second inlet configured to feed oil to the oil gallery.

In yet another example, an engine system (e.g., a locomotive engine system or engine system for another vehicle) comprises: a plate having a central aperture, a first support arm extending upwards from a first corner of the plate and a second support arm extending upwards from a second, diagonally opposite corner of the plate, each of the first and second support arms having a respective notch at an outer edge, a cylindrical oil feed body coupled in the central aperture such that a first portion of the feed body lies above a plane of the plate, and a second, remaining portion of the feed body lies below the plane of the plate, a first segmented tube protruding laterally from a first side of the first portion of the feed body, the first segmented tube including a first segment extending into and beyond the notch of the first support arm, and a second segment extending radially away from the notch of the first support arm, an outlet of the first support arm having a showerhead structure; and a second segmented tube protruding laterally from a second side, opposite the first side, of the first portion of the feed body, the second segmented tube having a third segment extending into and beyond the notch of the second support arm, and a forth segment extending radially away from the notch of the second support arm. In any preceding example, additionally or optionally, the first segment of the first segmented tube is coupled to the second segment via an angled segment, and wherein the third segment of the second segmented tube is coupled to the fourth segment via another angled segment. In any or all of the preceding examples, additionally or optionally, a longitudinal axis of the first segment positioned between the feed body and the notch of the first support arm is at an angle relative to a longitudinal axis of the second segment positioned beyond the notch of the first support arm, and wherein a longitudinal axis of the third segment positioned between the feed body and the notch of the second support arm is at an angle relative to a longitudinal axis of the fourth segment positioned beyond the notch of the second support arm. In any or all of the preceding examples, additionally or optionally, each of a first angle of the angled segment and a second angle of another angled segment are based on piston geometry.

Although embodiments are described herein as relating to locomotive engines, all such embodiments are also applicable to engines used in other vehicles (e.g., marine vessels, off-road haul trucks, on-road vehicles) and to engines used in other applications, e.g., engines for stationary electrical power generators.

References to bolts herein are also applicable to fasteners generally, such as screws, rivets, pins, etc.

This written description uses examples to disclose the invention, and to enable one of ordinary skill in the relevant art to practice embodiments of the invention, including making and using the devices or systems and performing the methods. The patentable scope of the invention is defined by the claims, and may include other examples that occur to one of ordinary skill in the relevant art. Such other examples are intended to be within the scope of the claims if they have structural elements that do not differ from the literal language of the claims, or if they include equivalent structural elements with insubstantial differences from the language of the claims.

The invention claimed is:

1. A piston cooling system for a locomotive engine, comprising:

a feed body hydraulically configured to be coupled to an oil reservoir, the feed body having a central axis;

a first piston cooling tube extending laterally to protrude radially out from one side of the feed body relative to the central axis, the first tube having a first showerhead outlet element; and a second piston cooling tube extending laterally to protrude radially out from another side of the feed body relative to the central axis, the second tube having a second showerhead outlet element, wherein the first piston cooling tube comprises a first section and a second section, the first section protruding laterally outwards from one side of the feed body along a first longitudinal axis, and the second section extending from the first section along a second longitudinal axis, the first longitudinal axis at a first angle relative to the central axis, the second axis at a second angle relative to the central axis, the first showerhead outlet element extending upwards from the second section, and wherein the second piston cooling tube comprises a third section and a fourth section, the third section protruding laterally outwards from the other side of the feed body along a third longitudinal axis, and the fourth section extending from the third section along a fourth longitudinal axis, the third longitudinal axis at a third angle relative to the central axis, the fourth axis at a fourth angle relative to the central axis, the second showerhead outlet element extending upwards from the fourth section.

2. The system of claim 1, wherein the first showerhead outlet element is positioned diametrically opposite to the second showerhead outlet element and wherein each of the first showerhead outlet element and the second showerhead outlet element include a larger central aperture radially surrounded by a plurality of smaller, peripheral apertures.

3. The system of claim 2, wherein each of the first showerhead outlet element and the second showerhead outlet element of the first and second cooling tubes are coupled to a main passage of the corresponding first and second cooling tubes via an angled, hollow connector element.

4. The system of claim 2, wherein the first longitudinal axis of the first cooling tube is at an angle relative to the central axis of the feed body on the side of the feed body, and wherein the third longitudinal axis of the second cooling tube is at the same angle relative to the central axis of the feed body on the another side of the feed body.

5. The system of claim 4, wherein an angle defined by the first longitudinal axis and the third longitudinal axis is in a range between 30 degrees and 90 degrees.

6. The system of claim 4, wherein a central axis of the first showerhead outlet element is angled relative to the first longitudinal axis of the first cooling tube, and wherein a central axis of the second showerhead outlet element of the second tube is angled relative to the third longitudinal axis of the second cooling tube.

7. The system of claim 5, wherein the first showerhead outlet element extends laterally away from each of the longitudinal axis of the first cooling tube and the central axis of the feed body, and wherein the second showerhead outlet element extends laterally away from each of the longitudinal axis of the second cooling tube and the central axis of the feed body.

8. The system of claim 1, wherein the feed body is coupled to a piston oil gallery housed within a piston, and wherein the first showerhead outlet element protrudes towards a first inlet of the piston oil gallery, and wherein the second showerhead outlet element protrudes towards a second inlet of the piston oil gallery, the first inlet located on a first side of the piston oil gallery relative to a central axis, the second inlet located on a second, opposite side of the piston oil gallery relative to the central axis.

9. The system of claim 1, wherein the feed body is cylindrical and coupled in between a first piston oil gallery housed within a first piston and a second piston oil gallery housed within a second piston, and wherein the first showerhead outlet element protrudes towards an inlet of the first piston oil gallery, and the second showerhead outlet element protrudes towards an inlet of the second piston oil gallery.

10. The system of claim 1, further comprising a fastening element having a first surface with a first circular recess for receiving the feed body, a second surface perpendicular to the first surface and having an oval recess through which the first cooling tube is supported, and a third surface perpendicular to the first surface and parallel to the second surface having another oval recess through which the second cooling tube is supported, the fastening element coupling the cooling system to an engine block via the first surface.

11. A cooling system in a locomotive engine, comprising:

a feed body for receiving oil from an oil sump and dispensing oil to a cylinder piston, the feed body having a central cylindrical region with a central axis, a tapered upper end and a tapered bottom end;

a first cooling tube having a first section extending upwards and protruding laterally outwards from one side of the central cylindrical region of the feed body along a first longitudinal axis, and a second section extending from the first section along a second longitudinal axis, the second axis at a first angle relative to the first axis, the first axis at a second angle relative to the central axis; and a second cooling tube having a first section extending upwards and protruding laterally outwards from another side of the central cylindrical region of the feed body along a third longitudinal axis, and a second section extending from the first section of the second cooling tube along a fourth longitudinal axis, the fourth axis at the first angle relative to the third axis, the third axis at the second angle relative to the central axis, wherein a respective outlet of the second section of each of the first and second cooling tubes has a large aperture surrounded circumferentially by a plurality of smaller apertures.

12. The system of claim 11, wherein the first section of each of the first and second cooling tubes includes a first set of connected passages, wherein the second section of each of the first and second cooling tubes includes a second passage, the first section coupled to the second section via an angled connector passage.

13. The system of claim 11, further comprising a fastening element for fastening the feed body, the first cooling tube, and the second cooling tube to a cylinder bore, the fastening element having a first surface with a first circular recess for receiving the feed body, a second surface having a plane perpendicular to a plane of the first surface and having an oval recess supporting the first section of the first cooling tube, and a third surface having a plane perpendicular to the first surface and parallel to the second surface, the third surface having another oval recess supporting the first section of the second cooling tube, wherein the second section of the first cooling tube extends beyond the second surface and the second section of the second cooling tube extends beyond the third surface.

14. The system of claim 13, wherein the plane of the first surface further includes a pair of openings on either side of the first circular recess for receiving a fastener for coupling the fastening element to the cylinder bore.

15. The system of claim 14, wherein the pair of openings are positioned along a first diagonal axis of the plane of the first surface, and wherein the second and third surfaces extend from the plane of the first surface along a second diagonal axis, perpendicular to the first diagonal axis.

16. The system of claim 11, wherein the feed body is coupled to a bottom surface of a cylinder bore, the cylinder bore housing the cylinder piston including an oil gallery comprising a hollow tubular structure formed within piston walls, and wherein the outlet of the first cooling tube protrudes towards a first inlet of the oil gallery, and the outlet of the second cooling tube protrudes towards a second inlet of the piston oil gallery, each of the first inlet and the second inlet configured to feed oil to the oil gallery.

17. A locomotive engine system, comprising:

a plate having a central aperture, a first support arm extending upwards from a first corner of the plate and a second support arm extending upwards from a second, diagonally opposite corner of the plate, each of the first and second support arms having a respective notch at an outer edge;

a cylindrical oil feed body coupled in the central aperture such that a first portion of the feed body lies above a plane of the plate, and a second, remaining portion of the feed body lies below the plane of the plate;

a first segmented tube protruding laterally from a first side of the first portion of the feed body, the first segmented tube including a first segment extending into and beyond the notch of the first support arm, and a second segment extending radially away from the notch of the first support arm, an outlet of the first support arm having a showerhead structure; and a second segmented tube protruding laterally from a second side, opposite the first side, of the first portion of the feed body, the second segmented tube having a third segment extending into and beyond the notch of the second support arm, and a forth segment extending radially away from the notch of the second support arm.

18. The system of claim 17, wherein the first segment of the first segmented tube is coupled to the second segment via an angled segment, and wherein the third segment of the second segmented tube is coupled to the fourth segment via another angled segment.

19. The system of claim 17, wherein a longitudinal axis of the first segment positioned between the feed body and the notch of the first support arm is at an angle relative to a longitudinal axis of the second segment positioned beyond the notch of the first support arm, and wherein a longitudinal axis of the third segment positioned between the feed body and the notch of the second support arm is at an angle relative to a longitudinal axis of the fourth segment positioned beyond the notch of the second support arm.

* * * * *